US012326326B1

(12) United States Patent
Cady

(10) Patent No.: US 12,326,326 B1
(45) Date of Patent: Jun. 10, 2025

(54) VEHICULAR FIREARM MAGAZINE HOLDING DEVICE

(71) Applicant: Joshua Cady, Crescent City, FL (US)

(72) Inventor: Joshua Cady, Crescent City, FL (US)

(73) Assignee: Door Mags, Inc., Pomona Park, FL (US)

( * ) Notice: Subject to any disclaimer, the term of this patent is extended or adjusted under 35 U.S.C. 154(b) by 0 days.

(21) Appl. No.: 18/761,736

(22) Filed: Jul. 2, 2024

Related U.S. Application Data

(60) Provisional application No. 63/562,206, filed on Mar. 6, 2024.

(51) Int. Cl.
*F42B 39/28* (2006.01)

(52) U.S. Cl.
CPC ..... *F42B 39/28* (2013.01)

(58) Field of Classification Search
CPC ..... F42B 39/28; F41C 33/02; F41C 33/06; B60R 7/046; B60R 7/14; B60R 2011/0021; B60R 2011/0019
See application file for complete search history.

(56) References Cited

U.S. PATENT DOCUMENTS 4,484,701 A * 11/1984 Frohn ..... B60R 7/088 224/543
4,749,112 A * 6/1988 Harper ..... B60N 3/108 224/567
5,379,787 A * 1/1995 Haines ..... B60N 3/083 296/37.9
5,511,711 A * 4/1996 Kunz ..... B60R 7/14 224/539
5,785,222 A * 7/1998 Basso ..... B60N 3/103 224/555
5,996,865 A * 12/1999 Bissey ..... B60R 7/043 224/42.32
6,116,672 A * 9/2000 Cannon ..... B60R 7/046 224/547
6,293,447 B1 * 9/2001 Jorgensen ..... B60R 7/14 224/571
6,880,874 B1 * 4/2005 Kallenberger ..... B60R 7/046 296/37.13
7,192,074 B2 * 3/2007 DePue ..... B60R 7/046 296/37.9

(Continued)

*Primary Examiner* — Dariush Seif
(74) *Attorney, Agent, or Firm* — Jason T. Daniel, Esq.; Daniel Law Offices, P.A.

(57) ABSTRACT

A firearm magazine holding device includes an elongated main body for being positioned within the door pocket of a motor vehicle. The main body includes an elongated general storage compartment and a plurality of firearm magazine slots. Each of the firearm magazine slots are oriented vertically for individually receiving and positioning a firearm magazine vertically within the device. Each firearm magazine slot includes a foam lining along the interior surface for engaging different sized firearm magazines within each slot. In some versions the main is manufactured to fit a specific vehicle and includes a shape and size that is complementary to the shape and size of the vehicles door pocket. In other embodiments, the main body is manufactured to fit a variety of different vehicles and includes a mounting lip along the front surface and an adhesive strip along the bottom surface and/or other surfaces.

16 Claims, 5 Drawing Sheets

(56) References Cited

U.S. PATENT DOCUMENTS 8,562,065 B2 * 10/2013 Langenbacher ..... B60N 3/101 296/146.7
9,114,839 B2 * 8/2015 Langenbacher ..... B60N 2/78
9,346,408 B2 * 5/2016 Plocher ..... B60J 5/0413
9,701,352 B2 * 7/2017 Langenbacher ..... B60N 3/10
10,232,790 B1 * 3/2019 Adrain ..... B60R 7/14
10,272,844 B1 * 4/2019 H N ..... B60R 11/0241
D939,240 S * 12/2021 Abascal ..... D6/552
2002/0185888 A1 * 12/2002 Jonardi ..... B60R 11/00 224/543
2005/0218170 A1 * 10/2005 Allmond ..... B60R 7/046 224/543
2006/0012205 A1 * 1/2006 Radu ..... B60R 7/046 296/37.13
2006/0062006 A1 * 3/2006 Radu ..... B29C 45/1671 362/154
2007/0290109 A1 * 12/2007 Ahlburg ..... B60R 7/046 248/311.2
2008/0011753 A1 * 1/2008 Browne ..... B60R 7/005 224/539
2012/0126570 A1 * 5/2012 Nagamura ..... B60R 7/046 296/146.7
2012/0132684 A1 * 5/2012 Ardigo ..... B60N 2/78 224/545
2012/0305613 A1 * 12/2012 Allen ..... A47B 81/005 224/545
2013/0094784 A1 * 4/2013 Musto, Jr. ..... F42B 39/02 112/475.17
2014/0069880 A1 * 3/2014 Spilotro ..... F42B 39/28 211/49.1
2015/0129440 A1 * 5/2015 Abascal ..... F41C 33/06 206/317
2019/0210538 A1 * 7/2019 Adrain ..... B60R 7/14
2022/0402438 A1 * 12/2022 Kim ..... B60R 7/046
2023/0419755 A1 * 12/2023 So ..... F41C 33/06

* cited by examiner

VEHICULAR FIREARM MAGAZINE HOLDING DEVICE

CROSS-REFERENCE TO RELATED APPLICATIONS

This application claims the benefit of U.S. Application Ser. No. 63/562,206 filed on Mar. 6, 2024, the contents of which are incorporated herein by reference.

TECHNICAL FIELD

The present invention relates generally to firearm accessories, and more particularly to a firearm magazine holder custom fit to a vehicle for storing spare magazines within the door pocket.

BACKGROUND

The statements in this section merely provide background information related to the present disclosure and may not constitute prior art.

Police officers are typically equipped with a tactical utility belt that contains a plurality of different items such as handcuffs, a flashlight, a handgun, a taser, and a nightstick, for example. Additionally, the belt often contains one or more utility pockets for carrying additional items such as a spare magazine, pepper spray or other such items. In either instance, the belt is designed to equip the officer with tools to handle most situations when they are away from their vehicle. However, most officers spend the majority of each shift within their patrol car. As such, officers routinely store the majority of their equipment within the vehicle. Indeed, one of the most common places for equipment storage is within the driver side door pockets that are typically located along the inside panel of the door at a location beneath the window.

Because police officers are trained to use the vehicle doors for cover in the event of an active shooter situation, most officers routinely store spare firearm magazines within the driver side door pocket of their vehicle. This location is specifically chosen to allow the officer to quickly obtain additional firearm magazines for one or more different weapon platforms when they are using the door for cover. Unfortunately, due to the small size of the magazines, and the large open space provided by the door pocket, along with the variety of other items often stored within the pocket, many officers have noted it can be extremely difficult to quickly find and retrieve a magazine from the pocket area in emergency situations. More specifically, the officers must often look into the pocket to attempt to find a magazine, thus taking their attention away from the active shooter.

Accordingly, it would be beneficial to provide a vehicular firearm magazine holding device that can be quickly and easily installed into a vehicle door pocket so as to overcome the drawbacks noted above.

SUMMARY OF THE INVENTION

The present invention is directed to a firearm magazine holding device. One embodiment of the present invention can include an elongated main body having a shape and size that is suitable for being positioned within the door pocket of a motor vehicle. In one embodiment, an elongated general storage compartment and a plurality of firearm magazine slots can extend downward from the top surface of the main body. Each of the firearm magazine slots can be oriented vertically and can receive and position a firearm magazine vertically within the device. In one embodiment, each magazine slot can include a shape and size that is complementary to a firearm magazine, and a foam lining can be provided within each slot to allow different sized firearm magazines to be accommodated within each slot.

In one embodiment, the main body can be manufactured to fit a specific vehicle and can include a shape and size that is complementary to the shape and size of the vehicle's door pocket. In one embodiment, the main body can be manufactured to fit a variety of different vehicles and can include a lip along the front surface and an adhesive strip along the bottom surface and/or other surfaces.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1:
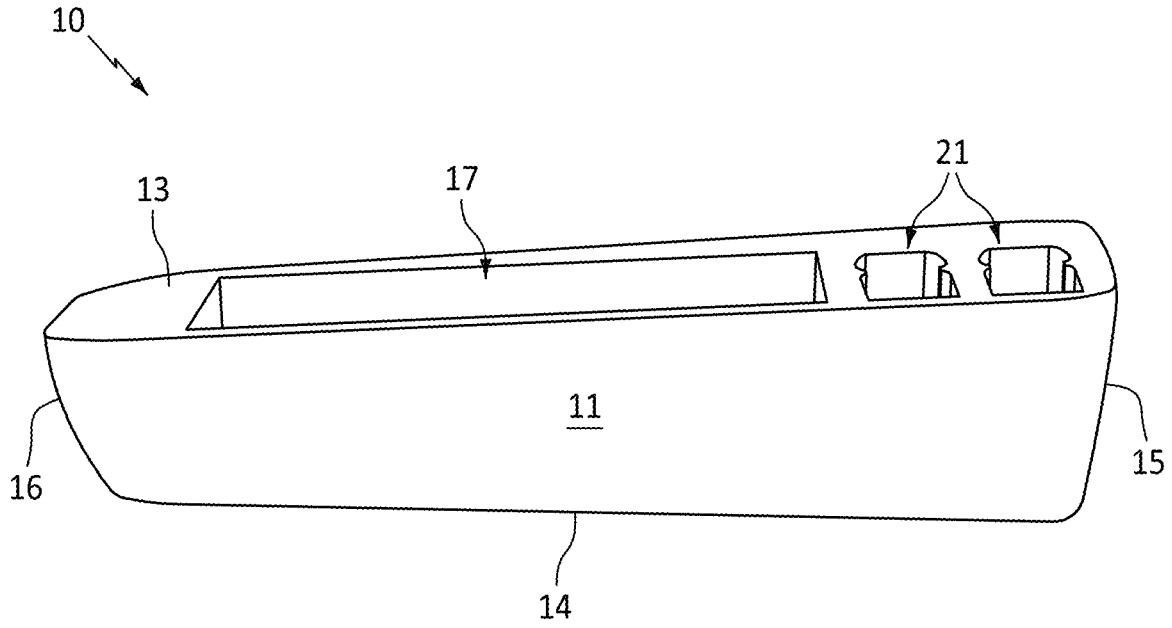
FIG. 1 is a side view of a vehicular firearm magazine holding device that is useful for understanding the inventive concepts disclosed herein.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

DEFINITIONS

As described herein, a "unit" means a series of identified physical components which are linked together and/or function together to perform a specified function.

As described throughout this document, the term "about" "approximately" "substantially" and "generally" shall be used interchangeably to describe a feature, shape or measurement of a component within a tolerance such as, for example, manufacturing tolerances, measurement tolerances or the like.

As described herein, the term "removably secured," and derivatives thereof shall be used to describe a situation wherein two or more objects are joined together in a non-permanent manner so as to allow the same objects to be repeatedly joined and separated.

As described throughout this document, the term "complementary shape," and "complementary dimension," shall be used to describe a shape and size of a component that is identical to, or substantially identical to the shape and size of another identified component within a tolerance such as, for example, manufacturing tolerances, measurement tolerances or the like.

As described herein, the term "connector" includes any number of different elements that work alone or together to repeatedly join two items together in a nonpermanent manner. Several nonlimiting examples of connectors include, but are not limited to, thread-to-connect, twist-to-connect, and push-to-connect type devices, opposing strips of hook and loop material (e.g., Velcro®), attractively oriented magnetic elements or magnetic and metallic elements, buckles, clamps, clips, and compression fittings such as hooks, snaps and buttons, for example. Each illustrated connector and complementary connector can be permanently secured to the illustrated portion of the device via a permanent sealer such as glue, adhesive tape, or stitching, for example.

FIGS. 1-6 illustrate one embodiment of a vehicular firearm magazine holding device 10 that are useful for understanding the inventive concepts disclosed herein. In each of the drawings, identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1.

Figure 2:
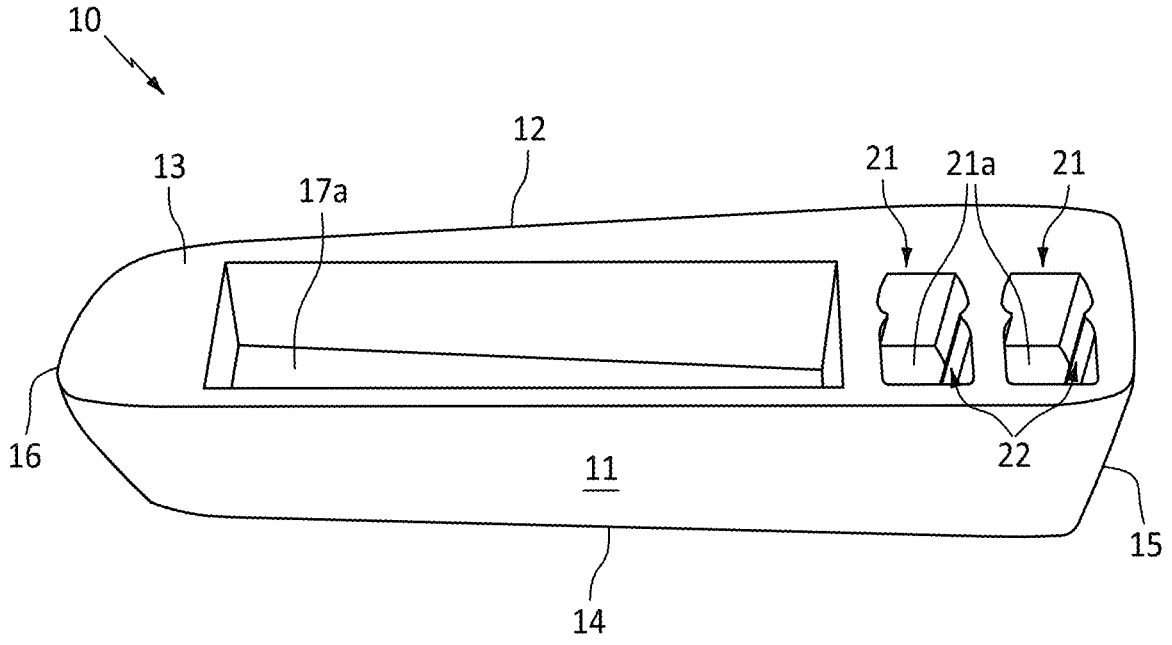
FIG. 2 is a perspective view of the vehicular firearm magazine holding device in accordance with one embodiment of the invention.

FIGS. 1 and 2 illustrate one embodiment of a vehicular firearm magazine holding device 10 that includes a main body having a front surface 11, a back surface 12, a top surface 13, a bottom surface 14 a first end 15 and a second end 16 that define an interior space.

As described herein, the main body may be formed from materials that are, for example, relatively strong and stiff for their weight. Several nonlimiting examples include but are not limited to various metals or metal alloys (e.g., aluminum, steel, titanium, or alloys thereof), plastic/polymers (e.g., high-density polyethylene (HDPE), rigid polyvinyl chloride (PVC), malleable polyethylene terephthalate (PET)), and/or various composite materials (e.g., carbon fibers in a polymer matrix, fiberglass, etc.).

In one embodiment, the device 10 can include a central storage compartment 17 that is formed by an elongated cavity having an open top end and a bottom surface 17*a* that extends downward from the top surface 13. The storage compartment 17 can function to receive and store any number of different items that would typically have been stored in the original storage pocket of the vehicle door, such that the device 10 does not reduce the functionality of the door pocket, while adding new functionality described below.

In one embodiment, a plurality of dedicated firearm magazine slots 21 can be provided. As shown, each of the slots can be positioned along the top surface 13 of the main body 10 and can include an open top end, and a generally vertically-oriented rectangular shaped interior space that leads to the bottom end 21*a*. In the preferred embodiment, the interior of the slot can include a shape that is complementary to the shape of a firearm magazine, such as a universal 9 mm handgun magazine, for example, and can be lined with foam 22 or other such material. The foam liner 22 advantageously allows the shape of the slot to expand and contract so as to receive and engage firearm magazines of varying shapes and sizes. Such a feature allows each slot to receive a single magazine and to position the same vertically so as to be easily grasped by an officer when needed. Although illustrated with regard to two slots, this is for illustrative purposes only, as any number of different firearm slots may be provided.

In one embodiment, the storage compartment and plurality of magazine slots may be formed from the same material as the main body and produced as a unitary component. In one embodiment, however, the main body can be formed from a first material (e.g., plastic, metal, etc.) to include a single hollow interior space between the surfaces and ends. In such an embodiment, the storage compartment and magazine slots may be formed by a second material (e.g., foam, plastic, etc) that is inserted into the single hollow interior space of the main body to form the finished product.

Such a feature advantageously allows the manufacturer to produce a variety of different inserts each containing any number of different compartments and slots in any number of different shapes, sizes and/or locations that can be combined with and inserted into the interior space of a single mass produced outer main body frame. This feature being particularly advantageous for adapting the system for use in different industries where the "magazine slots" are shaped and sized for different components as noted below.

Figure 3:
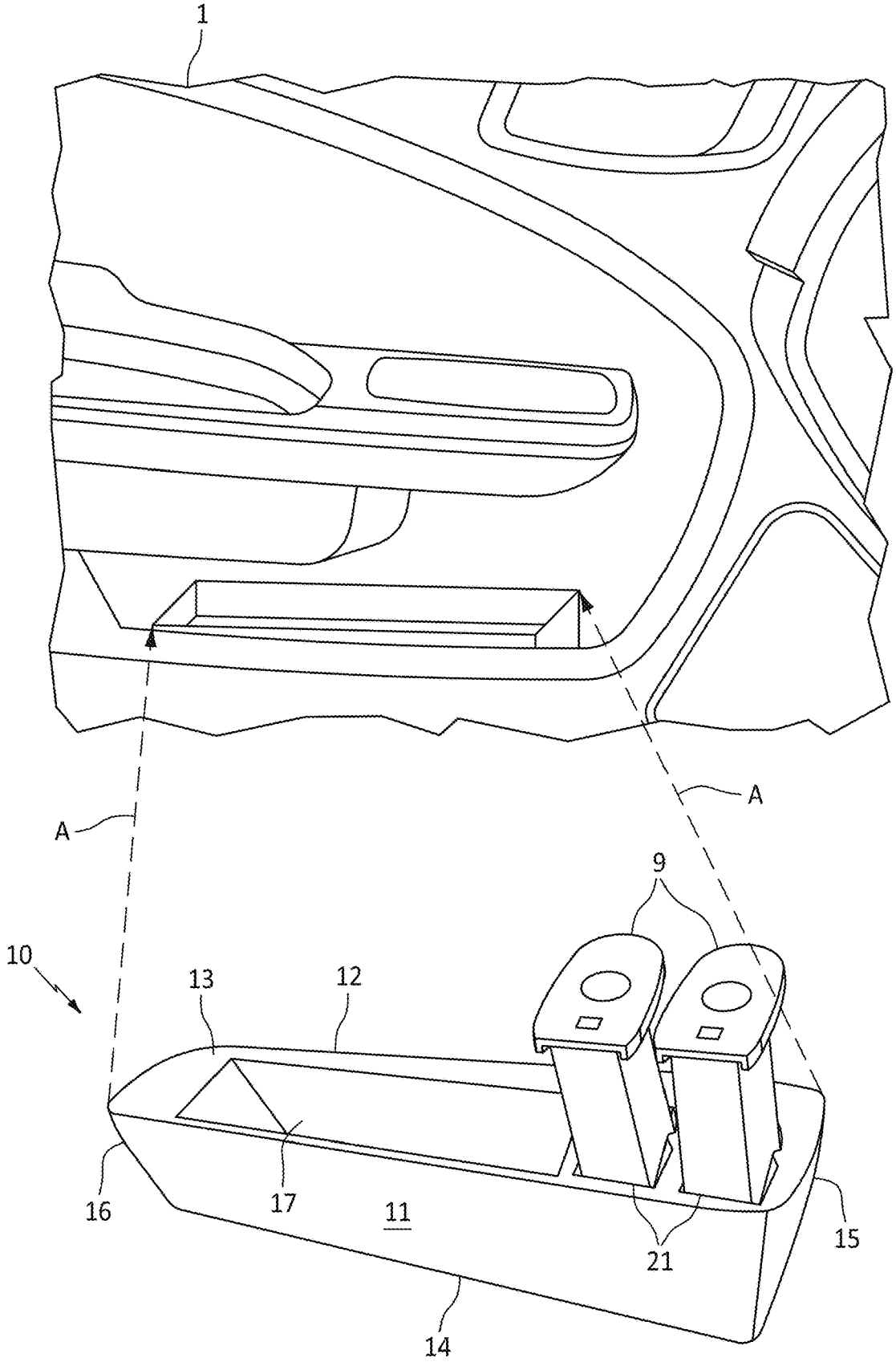
FIG. 3 is a perspective view of the vehicular firearm magazine holding device in operation, in accordance with one embodiment of the invention.
Figure 4:
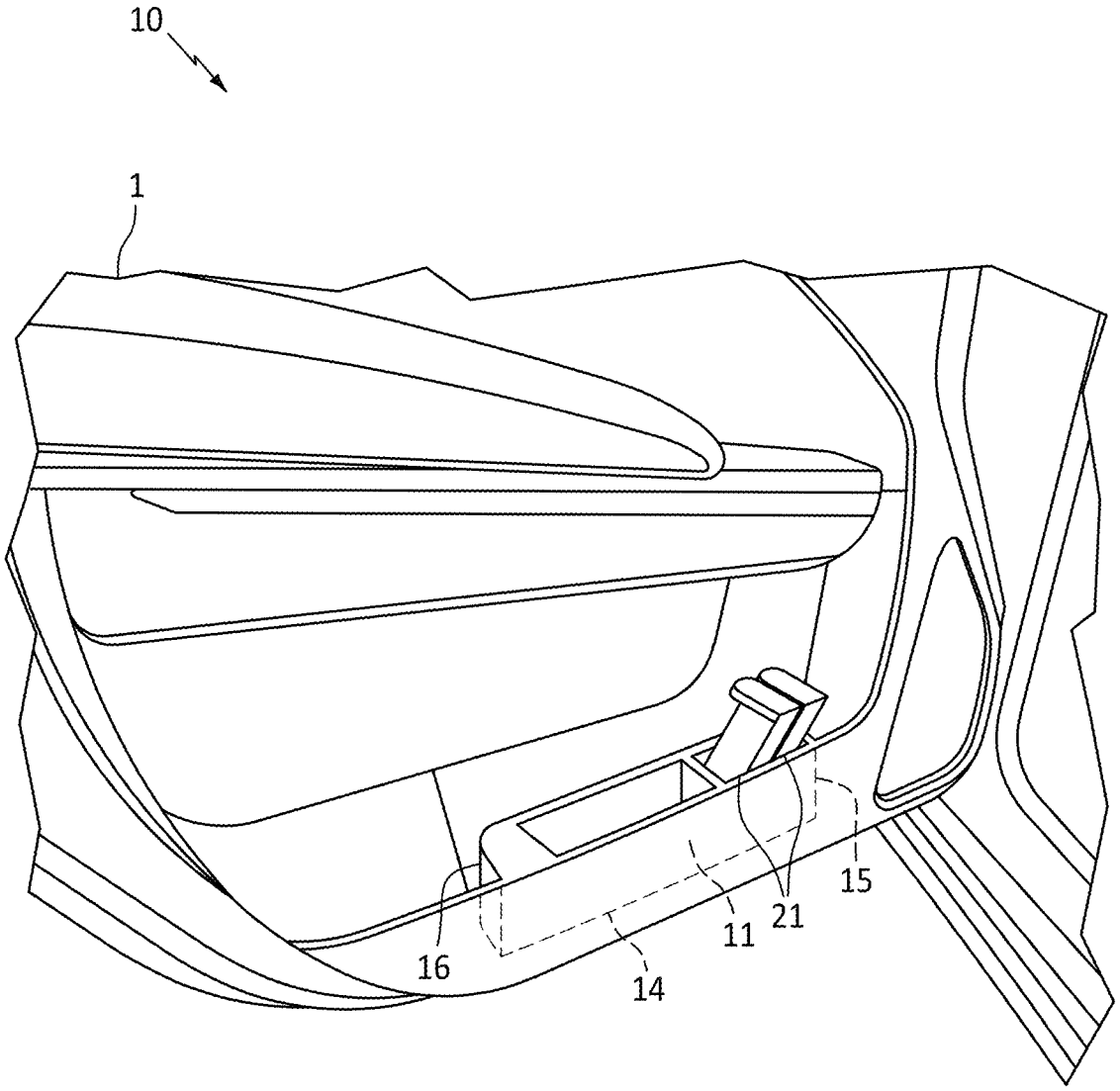
FIG. 4 is another perspective view of the vehicular firearm magazine holding device in operation, in accordance with one embodiment of the invention.

FIGS. 3 and 4 illustrate one embodiment of the device in operation with the door 1 of a vehicle such as the Explorer Police Interceptor vehicle commercially manufactured by Ford Motor Company®, for example, which is the most popular type of police vehicle currently in service. As shown, the door 1 can include an inside facing panel 2 having an elongated door pocket 3 with an interior space 3*a* that is located beneath an armrest 4 and a door lever 5.

In the preferred embodiment, the main body of the device 10 will be manufactured specifically to include a shape and a size that is complementary to the shape and size of a specific door pocket. As shown by arrow A, the device 10 can be simply inserted into the interior space of the door pocket 3, and any number of firearm magazines 9 can be positioned within the slots 21. When so positioned, the device 10 will remain affixed within the door pocket via the complementary shape.

Such a feature advantageously ensures the location of the firearm magazines 9 positioned within the magazine slots 21 will be located in an easy to reach location by an officer if/when they need to reload their firearm in an active shooting situation. By providing a specific location for their firearm magazines that will not shift or move, the device advantageously provides the officer with the ability to retrieve their magazines from the device using muscle memory and without having to take their eyes off the shooter in an emergency situation.

Figure 5:
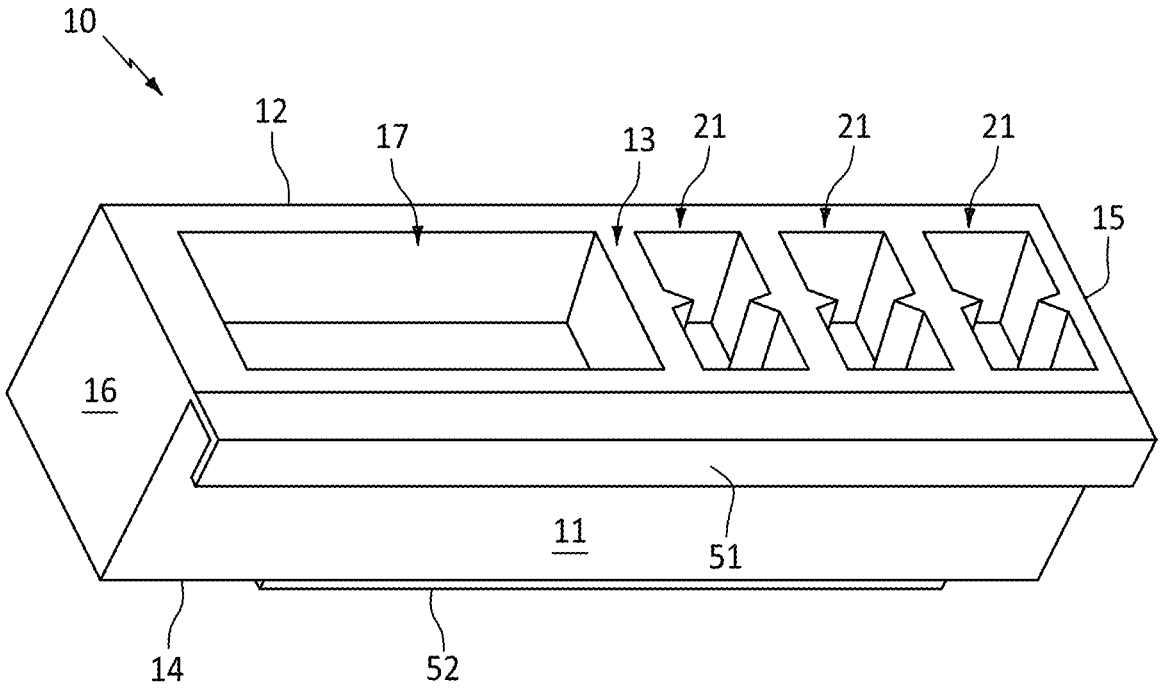
FIG. 5 is a perspective view of the vehicular firearm magazine holding device in accordance with one embodiment of the invention.
Figure 6:
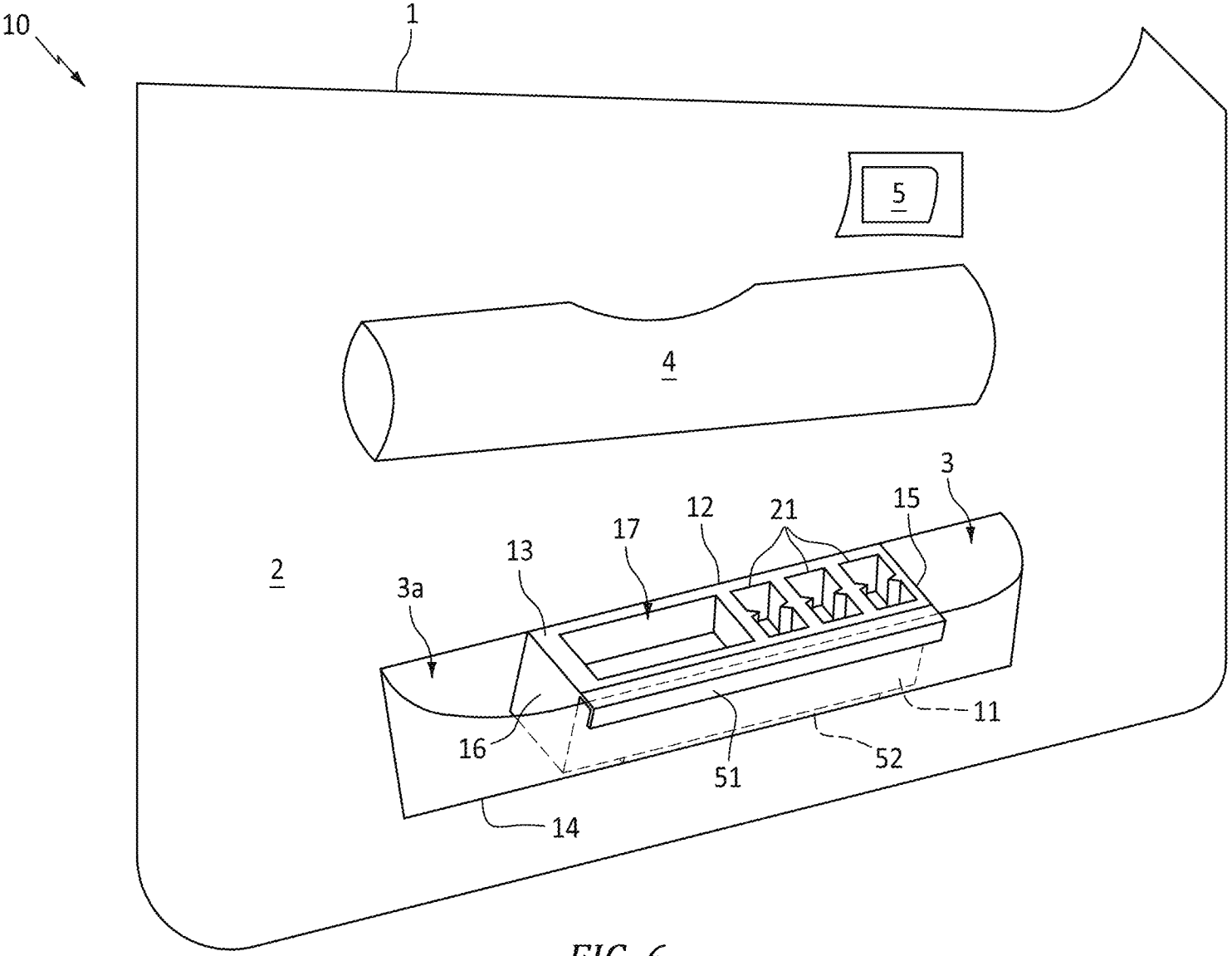
FIG. 6 is a perspective view of the vehicular firearm magazine holding device in operation, in accordance with one embodiment of the invention.

Although described above with regard to a specific shape for engaging the driver side door of a particular vehicle, other embodiments are contemplated. For example, FIGS. 5 and 6 illustrate one embodiment of the device 10 wherein the main body includes a shape that is different from the shape of the door pocket, such as the illustrated rectangular shape, for example, and further includes an attachment lip 51 or other such connector along the front surface 11 and an adhesive strip 52 or other such connector along the bottom surface 14.

In such an embodiment, the device can be secured into the door pocket 3 of a vehicle door such that the lip 51 engages the outside edge of the pocket, and the adhesive strip 52 engages the bottom surface of the pocket to prevent the installed device from moving.

Of course, the adhesive strip or other such connectors can be positioned along any other surface of the device for engaging different areas of the pocket and/or multiple adhesive strips can be utilized simultaneously. Such a feature advantageously allows a single device 10 to be utilized with multiple different types of vehicle storage pockets produced by different vehicular manufacturers.

Although described above as including both a central storage compartment and a plurality of magazine slots, this is for illustrative purposes only, as some embodiments are contemplated wherein the central storage compartment is omitted for the sake of providing additional magazine slots which may extend along a portion of, or the entirety of the top surface of the main body. Moreover, although described as an aftermarket component to fit a vehicle door, other embodiments are also contemplated wherein the device 10 may be manufactured so as to be an integral component with a vehicle door panel such as through molding or other construction techniques, so as to be formed as an OEM component.

Although described above as including a plurality of magazine slots for receiving firearm magazines for use in a police or military environment, this is for illustrative purposes only. To this end, other embodiments of the device are contemplated wherein the "magazine slots" are constructed to include shapes and sizes for receiving and engaging items other than firearm magazines. For example, one embodiment is contemplated for use by Emergency Medical personnel wherein the slots are shaped and sized to receive lifesaving items such as Narcan canisters, tunicates, PPE masks or other such items, for example. Such variations can be accomplished in light of the disclosure provided herein without undue experimentation.

As to a further description of the manner and use of the present invention, the same should be apparent from the above description. Accordingly, no further discussion relating to the manner of usage and operation will be provided.

As described herein, one or more elements of the device 10 can be secured together utilizing any number of known attachment means such as, for example, screws, glue, compression fittings and welds, among others. Moreover, although the above embodiments have been described as including separate individual elements, the inventive concepts disclosed herein are not so limiting. To this end, one of skill in the art will recognize that one or more individually identified elements may be formed together as one or more continuous elements, either through manufacturing processes, such as welding, casting, or molding, or through the use of a singular piece of material milled or machined with the aforementioned components forming identifiable sections thereof.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Likewise, the term "consisting" shall be used to describe only those components identified. In each instance where a device comprises certain elements, it will inherently consist of each of those identified elements as well.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A device, comprising:

a main body having a top surface, a bottom surface, a front surface, a back surface and a pair of side surfaces that define an interior space; and a plurality of firearm magazine slots that are positioned along the main body, each of the firearm magazine slots including an open top end that is located along the top surface of the main body, and a central body area that extends to a bottom end that is positioned within the interior space of the main body, wherein each of the plurality of firearm magazine slots includes a liner that is positioned along the entire central body area and bottom end, wherein the main body is configured to be positioned within the pocket of the vehicle door, wherein the main body includes a shape that is different from the shape of the door pocket such that a door pocket interior space is adjacent to a first end of the main body and another door pocket interior space is adjacent to a second end of the main body, wherein the main body further includes a connector along the front surface and an adhesive strip along the bottom surface of the main body, whereby the device can be secured into the door pocket of a vehicle door such that the connector engages the outside edge of the pocket, and the adhesive strip engages the bottom surface of the pocket to prevent the installed device from moving, wherein each of the at least one firearm magazine slots is configured to removably engage a firearm magazine, and wherein in an active shooting situation, firearm magazines are retrieved from the vehicle door pocket position without taking eyes off the shooter.

2. The device of claim 1, wherein each of the plurality of firearm magazine slots are configured to store the firearm magazine in a vertical orientation.

3. The device of claim 1, wherein each of the plurality of firearm magazine slots include a shape and a size that is complementary to a shape and a size of the firearm magazine.

4. The device of claim 3, wherein each of the plurality of firearm magazine slots are configured to store the firearm magazine in a vertical orientation.

5. The device of claim 1, further comprising:

a storage compartment that is positioned along the main body.

6. The device of claim 5, wherein the storage compartment comprises:

an elongated cavity extending downward from the top surface into the interior space of the main body.

7. The device of claim 1, wherein each of the plurality of firearm magazine slots include a shape and a size that is complementary to a shape and a size of the firearm magazine.

8. The device of claim 7, wherein each of the firearm magazine slots are configured to receive a universal 9 mm firearm magazine.

9. The device of claim 7, wherein each liner is positioned to vary the shape of the firearm magazine slots.

10. The device of claim 9, wherein each liner is configured to expand and contract to receive a plurality of different shaped firearm magazines within the slot in which the liner is positioned.

11. The device of claim 1, wherein the main body is constructed from the group consisting of metals, metal alloys, plastics, polymers, and composite materials.

12. The device of claim 1, further comprising:

a storage compartment that is positioned along the main body, said storage compartment extending from the top surface of the main body to the bottom surface of the main body, wherein the main body is constructed from the group consisting of metals, metal alloys, plastics, polymers, and composite materials;

and each of the storage compartment and the plurality of firearm magazine slots are fixedly formed within the main body to form a unitary component.

13. The device of claim 1, further comprising:

an attachment lip that is positioned along the front surface of the main body, said lip being configured to engage a top edge of the vehicle door pocket.

14. The device of claim 1, further comprising:

an adhesive strip that is located along the main body, said adhesive strip being configured to engage an inside portion of the vehicle door pocket.

15. A vehicle door, comprising:

a door panel having an inside facing surface, a door lever, and a firearm magazine holding device, said firearm magazine holding device comprising:

a main body having a top surface, a bottom surface, a front surface, a back surface and a pair of side surfaces that define an interior space; and a plurality of firearm magazine slots that are positioned along the main body, each of the firearm magazine slots including an open top end that is located along the top surface of the main body, and a central body area that extends to a bottom end that is positioned within the interior space of the main body, wherein each of the plurality of firearm magazine slots includes a liner that is positioned along the entire central body area and bottom end, wherein the main body is integrally positioned along a bottom portion of the door panel, and wherein the main body includes a shape that is different from the shape of the door pocket such that a door pocket interior space is adjacent to a first end of the main body and another door pocket interior space is adjacent to a second end of the main body, wherein the main body further includes a connector along the front surface and an adhesive strip along the bottom surface of the main body, whereby the device is secured into the door pocket of a vehicle door such that the connector engages the outside edge of the pocket, and the adhesive strip engages the bottom surface of the pocket, and wherein each of the at least one firearm magazine slot is configured to removably engage a firearm magazine, and wherein in an active shooting situation, firearm magazines are retrieved from the vehicle door pocket position without taking eyes off the shooter.

16. A device, consisting of:

a main body having a top surface, a bottom surface, a front surface, a back surface and a pair of side surfaces that define an interior space; and a plurality of firearm magazine slots that are positioned along the main body, each of the firearm magazine slots having an open top end that is located along the top surface of the main body, and a central body area that extends to a bottom end that is positioned within the interior space of the main body, wherein each of the plurality of firearm magazine slots includes a liner that is positioned along the entire central body area and bottom end, wherein the main body is configured to be positioned within the pocket of the vehicle door, wherein the main body includes a shape that is different from the shape of the door pocket such that a door pocket interior space is adjacent to a first end of the main body and another door pocket interior space is adjacent to a second end of the main body, wherein the main body further includes a connector along the front surface and an adhesive strip along the bottom surface of the main body, whereby the device can be secured into the door pocket of a vehicle door such that the connector engages the outside edge of the pocket, and the adhesive strip engages the bottom surface of the pocket to prevent the installed device from moving, and wherein each of the at least one firearm magazine slots is configured to removably engage a firearm magazine, and wherein in an active shooting situation, firearm magazines are retrieved from the vehicle door pocket position without taking eyes off the shooter.

* * * * *